US006498133B2

(12) United States Patent
Borchers et al.

(10) Patent No.: US 6,498,133 B2
(45) Date of Patent: Dec. 24, 2002

(54) PARTICULATE BLEACH ACTIVATORS BASED ON ACETONITRILES

(75) Inventors: Georg Borchers, Bad Nauhcim (DE); Robert Milbradt, Wiesbaden (DE); Oliver Mogck, Burgkirchen (DE); Frank Weinelt, Burgkirchen (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 09/993,819

(22) Filed: Nov. 16, 2001

(65) Prior Publication Data

US 2002/0107163 A1 Aug. 8, 2002

(30) Foreign Application Priority Data

Nov. 17, 2000 (DE) ..... 100 57 045

(51) Int. Cl.[7] ..... C11D 7/14; C11D 7/38; C11D 7/54

(52) U.S. Cl. ..... 510/314; 510/376; 510/445; 510/446; 510/452; 510/499; 510/500; 510/504; 510/511

(58) Field of Search ..... 510/314, 376, 510/445, 446, 452, 499, 500, 504, 511

(56) References Cited

U.S. PATENT DOCUMENTS

| | | | | |
|---|---|---|---|---|
| 3,822,114 A | | 7/1974 | Montgomery | 8/111 |
| 3,929,678 A | | 12/1975 | Laughling et al. | 252/526 |
| 6,107,266 A | | 8/2000 | Himmrich et al. | 510/314 |
| 6,168,077 B1 | | 1/2001 | Gray et al. | |
| 6,183,665 B1 | * | 2/2001 | Blondeau et al. | 252/186.39 |
| 6,225,274 B1 | | 5/2001 | Nitsch et al. | 510/314 |
| 6,235,218 B1 | * | 5/2001 | Annen et al. | 252/186.39 |
| 6,407,045 B1 | * | 6/2002 | Nitsch et al. | 510/220 |

FOREIGN PATENT DOCUMENTS

| | | |
|---|---|---|
| DE | 196 49 375 | 6/1998 |
| EP | 0 303 520 | 2/1989 |
| EP | 0 446 982 | 9/1991 |
| EP | 0 458 396 | 11/1991 |
| EP | 0 464 880 | 1/1992 |
| EP | 0 790 244 | 8/1997 |
| EP | 0 835 926 | 4/1998 |
| EP | 0 897 974 | 2/1999 |
| WO | 98/23531 | 6/1998 |
| WO | 00/36061 | 6/2000 |

OTHER PUBLICATIONS

ISO/IEC; International Standard; ISO/IEC 7816–1; "Identification Cards –Integrated Circuit(s) Cards with Contacts, Part 1: Physical Characteristics" ; 1998.

ISO/IEC; International Standard; ISO/IEC 7816–2; "Information Technology–Identification Cards–Integrated Circuit(s) Cards with Contacts" ; Part 2: Dimensions and Location of the Contacts; 1999.

ISO/IEC: International Standard; ISO/IEC 7816–3; "Information Technology–Integrated Circuit(s) Cards with Contacts"; Part 3: Electronic Signals and Transmission Protocols; 1997.

English abstract for EP 0790244, Aug. 20, 1997.

English abstract for EP 0897974, Feb. 24, 1999.

English abstract for WO 00/36061, Jun. 22, 2000.

Edward M. Arnett, et al., "Electronic effects on the menschutkin reaction. A complete kinetic and thermodynamic dissection of alkyl transfer to 3–and 4–substituted pyridines", J. Am. Chem. Soc., 102 (1980), p. 5892–5902.

Anthony M. Schwartz, et al., "Surface active agents", (1949), Title page and table of contents.

* cited by examiner

*Primary Examiner*—Gregory Delcotto
(74) *Attorney, Agent, or Firm*—Richard P. Silverman

(57) ABSTRACT

Particulate bleach activators comprising 15 to 60% by weight of an acetonitrile, 20 to 70% by weight of a silicon-containing carrier material and 20 to 30% by weight of water, which are obtained by applying an aqueous solution, saturated at 10 to 40° C., of an acetonitrile onto the carrier material without subsequent drying, where the amount of saturated aqueous solution is measured such that the given limits for acetonitrile, carrier material and water are observed.

12 Claims, No Drawings

PARTICULATE BLEACH ACTIVATORS BASED ON ACETONITRILES

BACKGROUND OF THE INVENTION

The present invention relates to particulate bleach activators based on acetonitriles, to a process for their preparation which consists in applying acetonitriles to silicon-containing carrier materials, and to the use of these products as bleach activators in solid laundry detergents and cleaning compositions.

Bleach activators are important constituents in compact detergents, stain-removal salts and machine dishwashing detergents. At temperatures as low as 40 to 60° C., they permit a bleaching result comparable with that of a boil wash by reacting with hydrogen peroxide-donors (in most cases perborates, percarbonates, persilicates and perphosphates) to release peroxy acids.

Many substances are known as bleach activators in the prior art. They are usually reactive organic compounds with an O-acyl or N-acyl group which, in alkaline solution together with a source of hydrogen peroxide, form the corresponding peroxy acids.

Representative examples of bleach activators are N,N,N',N'-tetraacetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglucoluril (TAGU), tetraacetylcyanic acid (TACA), di-N-acetyidimethylglyoxine (ADMG) and 1-phenyl-3-acetylhydantoin (PAH).

Ammonium nitrites form a particular class of cationic bleach activators. Compounds of this type and the use thereof as bleach activators in bleaches are described in EP-A-0 303 520, EP-A-0 464 880, EP-A-0 458 396, EP-A-0 897 974 and EP-A-0 790 244.

For the use of the ammonium nitrites as bleach activator in laundry detergents and cleaning compositions, the hygroscopicity of the ammonium nitrites and the sensitivity to hydrolysis in the presence of alkaline laundry detergent constituents and a correspondingly low storage stability associated therewith are highly disadvantageous.

WO 98/23531 and WO 00/36061 describe that acetonitrile derivatives, in particular cyclic acetonitrile compounds, are converted into a solid form for incorporation into solid laundry detergents and cleaning compositions by stirring a carrier material having the largest possible surface area, for example silica, into an aqueous acetonitrile solution, or by spraying the aqueous solution onto the carrier, and subjecting the resulting mixture to drying under reduced pressure at elevated temperatures. The granules or particles described in these specifications have water contents of up to 20% by weight, preferably less than 1 percent by weight. An unsatisfactory aspect is the hygroscopicity and, consequently, the storage stability of the products, in particular of the linear acetonitrile derivatives at fluctuating atmospheric humidity, and the partial decomposition of the hydrolysis-sensitive acetonitrile compounds during the thermal drying process.

SUMMARY OF THE INVENTION

Surprisingly, it has been found that formulating in the form of granules or particles of the acetonitrile derivatives can be carried out in a manner which is very gentle to the active ingredient, but is also very advantageous with regard to costs and environment, by spraying aqueous solutions, saturated at room temperature, of acetonitrile derivatives onto a silicon-containing carrier material, in particular silica, without subsequent drying. This gives solid products with a water content of from 20 to 30% by weight. A drying process, which is energy-intensive and unfavorable for the active ingredient, can be dispensed with. The active ingredient concentration of the products prepared by the process according to the invention is greater than that of conventional products, and the hygroscopicity of the acetonitrile derivatives formulated in accordance with the invention is significantly lower.

The invention provides particulate bleach activators comprising 15 to 60% by weight, preferably 20 to 50% by weight, in particular 35 to 45% by weight, of an acetonitrile, 20 to 70% by weight, preferably 30 to 50% by weight, in particular 35 to 45% by weight, of a silicon-containing carrier matieral, and 20 to 30% by weight, preferably 22 to 25% by weight, of water.

Such acetonitriles are compounds of the formula

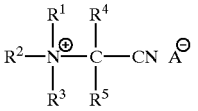

in which $R^1$, $R^2$, $R^3$ are identical or different and are linear or branched $C_1$–$C_{24}$-alkyl groups, $C_2$–$C_{24}$-alkenyl groups or are $C_1$–$C_4$-alkoxy-$C_1$–$C_4$-alkyl groups, substituted or unsubstituted benzyl, or in which $R^1$ and $R^2$, together with the nitrogen atom to which they are bonded, form a ring having 4 to 6 carbon atoms which may be substituted by $C_1$–$C_5$-alkyl, $C_1$–$C_5$-alkoxy, $C_1$- to $C_5$-alkanoyl, phenyl, amino, ammonium, cyano, cyanamino, chlorine or bromine, and, in addition to the nitrogen atom, may contain one or two oxygen or nitrogen atoms, a group N—$R^6$ or a group $R^3$—N—$R^6$ instead of carbon atoms, in which $R^6$ is hydrogen, $C_1$- to $C_5$-alkyl, $C_2$- to $C_5$-alkenyl, $C_2$- to $C_5$-alkynyl, phenyl, $C_7$- to $C_9$-aralkyl, $C_5$- to $C_7$-cycloalkyl, $C_1$- to $C_6$-alkanoyl, cyanomethyl or cyano, $R^4$ and $R^5$ are hydrogen, $C_1$–$C_4$-alkyl, $C_2$–$C_4$-alkenyl, $C_1$–$C_4$-alkoxy-$C_1$–$C_4$-alkyl, phenyl or $C_1$–$C_3$-alkylphenyl, preferably hydrogen, methyl or phenyl, where, in particular, $R^4$ is hydrogen if $R^5$ is not hydrogen, and A is any desired anion, for example chloride, bromide, iodide, fluoride, sulfate, hydrogensulfate, carbonate, hydrogencarbonate, phosphate, mono- and di-hydrogenphosphate, pyrophosphate, metaphosphate, nitrate, methylsulfate, phosphonate, methylphosphonate, methanedisulfonate, methylsulfonate, ethanesulfonate or is an anion of the formulae $RSO_3^{\ominus}$, $R^1SO_4^{\ominus}$ or $R^2COO^{\ominus}$, where R, $R^1$ and $R^2$ are $C_8$–$C_{20}$-alkyl, preferably $C_{10}$–$C_{18}$-alkyl, and $R^1$ is additionally also substituted aryl, preferably $C_1$–$C_{18}$-alkylphenyl. Particular preference is given to cumenesulfonate and $C_{12/18}$-alcohol sulfate as anion.

Particular preference is given to compounds of the above formula in which $R^1$, $R^2$ and $R^3$ are $C_1$–$C_4$-alkyl, and $R^4$ and $R^5$ are hydrogen, and A is any desired cation, preferably chloride, methosulfate, cumenesulfonate, lauryl sulfate or fatty acid alkyl carboxylates or mixtures of these cations.

The synthesis of these acetonitriles can be carried out by known processes, as published, for example, by Abraham in Progr. Phys. Org. Chem. 11 (1974), p. 1 ff, or by Arnett in J. Am Chem. Soc. 102 (1980), p. 5892 ff.

These acetonitriles are used to prepare a saturated aqueous solution which is applied to the silicon-containing carrier material, preferably by spraying, for example via a two-material nozzle. The temperature of this saturated aqueous solution is preferably 10 to 40° C., particularly preferably 20 to 25° C. The material can then be after-mixed. The amount of saturated aqueous solution is measured such that the limits given above for acetonitrile, carrier material and water are observed.

Preferred silicon-containing carrier materials are preferably those whose internal surface area is in the range from 10 $m^2/g$ to 500 $m^2/g$, in particular 100 $m^2/g$ to 450 $m^2/g$. Examples of suitable materials are silicates, silicas, silica gels and clays, and mixtures thereof. The carrier material is preferably free from strongly alkaline constituents.

Silicas which have been prepared by the thermal process (flame hydrolysis of $SiCl_4$) (so-called pyrogenic silicas) can be used as well as silicas prepared by wet processes. Silica gels are colloidal silicas with elastic to solid consistency and a largely loose pore structure, resulting in a high liquid absorption capacity. They can be prepared by reacting mineral acids on water glass. Clays are naturally occurring crystalline or amorphous silicates of aluminum, iron, magnesium, calcium, potassium and sodium, for example kaolin, talc, pyrophyllite, aftapulgite, sepiolite, montmorillonite and bauxite. The use of aluminum silicate as carrier material or as component of a carrier material mixture is also possible. The carrier material preferably has particle sizes in the range from 10 $\mu$m to 1.5 mm.

In order to ensure sufficient storage stability and to liberate the bleach-activating action only during the wash operation, it is advantageous to then granulate the carrier material loaded with the acetonitrile. The carrier material loaded with the acetonitrile can, with or without the addition of a binder, likewise be compressed, compacted and be gently comminuted to granule sizes of from 200 to 2000 $\mu$m.

Also suitable is a build-up granulation in a mixer, for example in a plowshare mixer, annular bed mixer or intensive mixer with or without the addition of a binder, for example a water-based binder, such as Tylose™ (carboxymethylcellulose) or an anhydrous binder system, such as fatty alcohol polyglycol ether.

In a further embodiment, the particulate product obtained by spraying a saturated solution of the acetonitrile onto a carrier material can, with or without the addition of a binder, be subjected to a shaping granulation through dies in an extruder, or else in annular edge-runner presses, edge runners, optionally with downstream rounding equipment.

The particulate bleach activators obtained according to the invention are suitable for direct use in laundry detergents and cleaning compositions. In order to avoid fabric and color damage, it is advantageous, however, to provide the particulate bleach activators with a coating in accordance with processes known in the art. For this purpose, the granules are coated in an additional step with a film-forming substance by methods known in the art, as a result of which the product properties can be considerably influenced. Suitable coating materials are all film-forming substances, such as waxes, silicones, fatty acids, soaps, anionic surfactants, nonionic surfactants, cationic surfactants, and anionic and cationic polymers, e.g. polyacrylic acids. By using these coating materials, it is possible, inter alia, to delay the dissolution behavior in order, in this way, to also suppress interaction between the bleach activator and the enzyme system at the start of the washing process. If the granules are to be used in machine dishwashing detergents, waxes with melting points of from 40 to 50° C. are particularly suitable for this purpose.

Preference is given to using coating substances with a melting point of from 30 to 100° C. Examples thereof and an application process are described in EP-A-0 835 926. The coating materials are usually applied by spraying the molten coating materials or coating materials dissolved in a solvent. The coating material can be applied in amounts of from 0 to 30% by weight, preferably 5 to 20% by weight, based on the total weight, onto the granule core according to the invention.

Moreover, the particulate bleach activators according to the invention can also comprise further suitable additives, such as anionic and nonionic surfactants, which contribute to more rapid dissolution of the granules according to the invention. Preferred anionic surfactants are alkali metal salts, ammonium salts, amine salts and salts of aminoalcohols from the following compounds: alkyl sulfates, alkyl ether sulfates, alkylamide sulfates and alkylamide ether sulfates, alkylaryl polyether sulfates, monoglyceride sulfates, alkylsulfonates, alkylamidesulfonates, alkylarylsulfonates, α-olefinsulfonates, alkyl sulfosuccinates, alkyl ether sulfosuccinates, alkylamide sulfosuccinates, alkyl sulfoacetates, alkylpolyglycerol carboxylates, alkyl phosphates, alkyl ether phosphates, alkyl sarcosinates, alkyl polypeptidates, alkylamidopolypeptidates, alkyl isethionates, alkyl taurates, alkylpolyglycol ether carboxylic acids or fatty acids, such as oleic acid, ricinoleic acid, palmitic acid, stearic acid, copra oil acid salts or hydrogenated copra oil acid salts. The alkyl radical of all of these compounds normally contains 8 to 32, preferably 8 to 22, carbon atoms.

Preferred nonionic surfactants are polyethoxylated, polypropoxylated or polyglycerolated ethers of fatty alcohols, polyethoxylated, polypropoxylated and polyglycerolated fatty acid esters, polyethoxylated esters of fatty acids and of sorbitol, polyethoxylated or polyglycerolated fatty amides.

Suitable additives are also substances which influence the pH during storage and use. These include organic carboxylic acids or salts thereof, such as citric acid in anhydrous or hydrated form, glycolic acid, succinic acid, maleic acid or lactic acid. In addition, additives are possible which influence the bleaching ability, such as complexing agents and transition metal complexes, e.g. iron-, cobalt- or manganese-containing metal complexes, as described in EP-A-0 458 397 and EP-A-0 458 398.

Further possible additives are substances which, in the wash liquor, react with the peroxycarboxylic acid liberated by the activator to form reactive intermediates, such as dioxiranes or oxaziridines, and in this way can increase the reactivity. Corresponding compounds are ketones and sulfonimines corresponding to U.S. Pat. No. 3,822,114 and EP-A-0 446 982.

The amount of the additive depends, in particular, on its nature. For example, acidifying additives and organic catalysts for increasing the performance of the peracid are added in amounts of from 0 to 20% by weight, in particular in amounts of from 1 to 10% by weight, based on the total weight, whereas metal complexes are added in concentrations in the ppm range.

In a further preferred embodiment, the particulate bleach activators according to the invention can be incorporated into tableted laundry detergent and cleaning composition formulations in accordance with customary methods. To prepare cleaning compositions in tablet form, the procedure preferably involves mixing all of the constituents in a mixer and compressing the mixture by means of customary tableting presses, for example eccentric presses or rotary presses, using pressing forces in the range from $200\times10^5$ Pa to $1500\times10^5$ Pa. This gives, without problems, tablets which are resistant to breakage but which nevertheless dissolve sufficiently rapidly under application conditions and which have flexural strengths of more than 150 N. A tablet prepared in this way preferably has a weight of from 15 g to 40 g, in particular from 20 g to 30 g, for a diameter of from 35 mm to 40 mm.

The acetonitrile derivatives formulated according to the invention can be used in heavy-duty detergents, stain-removal salts, machine dishwashing detergents, pulverulent all-purpose cleaners and denture cleansers.

The laundry detergents and cleaning compositions comprising the above-described acetonitrile derivatives formulated in the form of particles are used in combination with a source of hydrogen peroxide, for example perborate monohydrate, perborate tetrahydrate, percarbonate, and hydrogen peroxide adducts with urea or amine oxides, and can comprise all ingredients customary in these compositions such as builder substances, surfactants, enzymes, sequestering agents, electrolytes, pH regulators, foam regulators, abrasives, brighteners, silver corrosion inhibitors, preservatives, perfumes and fragrances.

Suitable builders are phosphate-free builder systems and also phosphate-containing systems, for example alkali metal phosphates, which can be present in the form of their alkaline, neutral or acidic sodium or potassium salts, such as trisodium phosphate, tetrasodium diphosphate, disodium dihydrogenphosphate, pentasodium triphosphate, so-called sodium hexametaphosphate, oligomeric trisodium phosphate with oligomerization amounts in the range from 5 to 1000, in particular 5 to 50, and mixtures of sodium and potassium salts. Finely crystalline synthetic water-containing zeolites of the NaA type which have a calcium-binding capacity in the range from 100 to 200 mg of CaO/g are preferably used. These zeolites can be present in an amount up to 20% by weight in the composition. Builders which can be used are also the percarboxylic acids used preferably in the form of their sodium salts, such as citric acid and nitriloacetate (NTA), ethylenediaminetetraacetic acid. Analogously thereto, it is also possible to use polymeric carboxylates and salts thereof. These include, for example, the salts of homopolymeric or copolymeric polyacrylates, polymethacrylates and, in particular, copolymers of acrylic acid with maleic acid, and also polyvinylpyrrolidone and urethanes. The relative molecular mass of the homopolymers is generally between 1000 and 100000, that of the copolymers is between 2000 and 200000, preferably 50000 to 120000, based on the free acid. In particular, water-soluble polyacrylates are also suitable which have been crosslinked, for example, with approximately 1% of a polyallyl ether of sucrose and which have a relative molecular mass above one million. Examples thereof are the polymers obtainable under the name Carbopol® 940 and 941. The crosslinked polyacrylates are used in amounts not exceeding 1% by weight, preferably in amounts of from 0.2 to 0.7% by weight. These backbone substances can be used in amounts up to 5% by weight. Preferred anionic surfactants are $C_8$–$C_{20}$-fatty acid α-methyl ester sulfonates, alkyl sulfates, alkyl ether sulfates and sec-alkanesulfonates.

The alkyl ether sulfates used in the compositions according to the invention are water-soluble salts or acids of the formula $RO(A)_mSO_3M$, in which R is an unsubstituted $C_{10}$–$C_{24}$-alkyl or $C_{10}$–$C_{24}$-hydroxyalkyl radical, preferably a $C_{12}$–$C_{20}$-alkyl or $C_{12}$–$C_{20}$-hydroxyalkyl radical, particularly preferably $C_{12}$–$C_{18}$-alkyl or $C_{12}$–$C_{18}$-hydroxyalkyl radical. "A" is an ethoxy or propoxy unit, m is a number greater than 0, preferably between 0.5 and about 6, particularly preferably between about 0.5 and about 3 and M is a hydrogen atom or a cation, such as, for example, a metal cation (e.g. sodium, potassium, lithium, calcium, magnesium, etc.), ammonium or a substituted ammonium cation. Specific examples of substituted ammonium cations are methylammonium, dimethylammonium, trimethylammonium and quaternary ammonium cations, such as tetramethylammonium and dimethylpiperidinium cations, and those which are derived from alkylamines, such as ethylamine, diethylamine, triethylamine. Examples of these alkyl ether sulfates which may be mentioned are $C_{12}$–$C_{18}$-alkyl polyethoxylate(1.0) sulfate, ($C_{12}$–$C_{18}$E(1.0)M), $C_{12}$–$C_{18}$-alkyl polyethoxylate(2.25) sulfate ($C_{12}$–$C_{18}$E(2,25)M), $C_{12}$–$C_{18}$-alkyl polyethoxylate(3.0) sulfate ($C_{12}$–$C_{18}$E(3,0)M), $C_{12}$–$C_{18}$-alkyl polyethoxylate(4.0) sulfate ($C_{12}$–$C_{18}$E(4.0)M).

In the case of the secondary alkanesulfonates, the alkyl group can either be saturated or unsaturated, branched or linear and optionally substituted by a hydroxyl group. The sulfo group is randomly distributed over the entire carbon chain, where the primary methyl groups on the start of the chain and on the end of the chain do not have sulfonate groups. Preferred secondary alkanesulfonates contain linear alkyl chains having 9 to 25 carbon atoms, preferably from 10 to 20 carbon atoms and particularly preferably 13 to 17 carbon atoms. The cation is sodium, potassium, ammonium, mono-, di- or triethanolammonium, calcium or magnesium and mixtures thereof. For the sake of simplicity, sodium is preferred as cation.

In addition to or instead of these preferred anionic surfactants, the laundry detergents and cleaning compositions can also comprise other types of anionic surfactants, such as, for example, alkyl sulfates, alkylsulfonates, alkyl carboxylates, alkyl phosphates and mixtures of said compounds. Suitable cations are, for example, sodium, potassium, calcium or magnesium, and ammonium, substituted ammonium compounds, including mono-, di- or triethanolammonium cations, and mixtures of these cations.

Here, alkyl sulfates are water-soluble salts or acids of the formula $ROSO_3M$, in which R is preferably a $C_{10}$–$C_{24}$-hydrocarbon radical, preferably an alkyl or hydroxyalkyl radical having $C_{10}$–$C_{20}$-alkyl components, particularly preferably a $C_{12}$–$C_{18}$-alkyl or hydroxyalkyl radical. M is hydrogen or a cation, e.g. sodium, potassium, lithium or ammonium or substituted ammonium, e.g. methyl-, dimethyl- and trimethylammonium cations and quaternary ammonium cations, such as tetramethylammonium and dimethylpiperidinium cations and quaternary ammonium cations derived from alkylamines, such as ethylamine, diethylamine, triethylamine and mixtures thereof.

A further suitable anionic surfactant is alkylbenzenesulfonate. The alkyl group can either be saturated or unsaturated, branched or linear and optionally substituted by a hydroxyl group.

The preferred alkylbenzenesulfonates contain linear alkyl chains having 9 to 25 carbon atoms, preferably 10 to 13 carbon atoms, and the cation is sodium, potassium, ammonium, mono-, di- or triethylammonium, calcium or magnesium and mixtures thereof.

Further suitable anionic surfactants are carboxylates, e.g. fatty acid soaps and comparable surfactants. The soaps can be saturated or unsaturated and can contain various substituents, such as hydroxyl groups or alpha-sulfonate groups. Preference is given to linear saturated or unsaturated hydrocarbon radicals as hydrophobic component in the soaps. The hydrophobic components usually contain 6 to 30 carbon atoms, preferably 10 to 18 carbon atoms. Further anionic surfactants are salts of acylaminocarboxylic acids, which are formed by reacting fatty acid chlorides with sodium sarcosinate in alkaline medium (acyl sarcosinates), and also fatty acid protein condensation products which are obtained by reacting fatty acid chlorides with oligopeptides. The salts of alkylsulfamidocarboxylic acids and the salts of alkyl and alkylaryl ether carboxylic acids also have surfactant character.

Other anionic surfactants which are useful for use in laundry detergents and cleaning compositions are $C_8$–$C_{24}$ olefinsulfonates, sulfonated polycarboxylic acids prepared by sulfonating the pyrolysis products of alkaline earth metal citrates, as described, for example, in GB 1 082 179, alkylglycerol sulfates, fatty acyl glycerol sulfates, oleylglycerol sulfates, alkylphenol ether sulfates, primary paraffinsulfonates, alkyl phosphates, alkyl ether phosphates, isethionates, such as acyl isethionates, N-acyltaurides, alkyl succinamates, sulfosuccinates, monoesters of sulfosuccinates (particularly saturated and unsaturated $C_{12}$–$C_{18}$-monoesters) and diesters of sulfosuccinates (particularly saturated and unsaturated $C_{12}$–$C_{18}$-diesters), acylsarcosinates, sulfates of alkyl polysaccharides, such as sulfates of alkyl glycosides, branched primary alkylsulfates and alkyl polyethoxycarboxylates, such as those of the formula $RO(CH_2CH_2)_kCH_2COOM$, in which R is $C_8$–$C_{22}$-alkyl, k is a number from 0 to 10 and M is a cation which forms a soluble salt. Resin acids or hydrogenated resin acids, such as rosin or hydrogenated rosin or tall oil resins and tall oil resin acids can likewise be used. Further examples are described in "Surface Active Agents and Detergents" (Vol. I and II, Schwartz, Perry and Berch). A large number of such surfactants are also described in U.S. Pat. No. 3,929,678.

Typical examples of anionic surfactants are also alkyl ether sulfonates, glycerol ether sulfonates, sulfo fatty acids, glycerol ether sulfates, hydroxy mixed ether sulfates, fatty acid amide (ether) sulfates, mono- and dialkyl sulfosuccinates, mono- and dialkyl sulfosuccinamates, sulfotriglycerides, amide soaps, alkyl oligoglucoside sulfates, alkylamino sugar sulfates and alkyl (ether) phosphates. If the anionic surfactants contain polyglycol ether chains, they can have a conventional or a narrowed homolog distribution.

In the laundry detergent and cleaning compositions it is likewise possible to use nonionic surfactants, such as fatty acid alkyl ester alkoxylates, alkyl and/or alkenyl oligoglycosides, fatty alcohol polyglycol ethers, alkylphenol polyglycol ethers, fatty acid polyglycol esters, fatty acid amide polyglycol ethers, fatty amine polyglycol ethers, alkoxylated triglycerides, fatty acid glucamides, polyoil fatty acid esters, sugar esters, sorbitan esters and polysorbates and/or alkoxylated fatty alcohols.

Furthermore, cosurfactants from the group of alkylbetaines, alkylamidobetaines, aminopropionates, aminoglycinates, imidazoliniumbetaines and sulfobetaines, amine oxides and fatty acid alkanolamides or polyhydroxyamides, can be used.

In addition to the bleach-activating acetonitrile derivatives, it is possible to use known conventional bleach activators, i.e. compounds which, under perhydrolysis conditions, give aliphatic peroxocarboxylic acids and/or optionally substituted perbenzoic acids.

Suitable substances are organic compounds with a O-acyl or N-acyl group, in particular from the group of activated carboxylates, in particular sodium nonanoyloxybenzenesulfonate, sodium isononanoyloxybenzenesulfonate, sodium 4-benzoyloxybenzenesulfonate, sodium trimethylhexanoyloxybenzenesulfonate, carboxylic anhydrides, in particular phthalic anhydride, acylated polyhydric alcohols, in particular triacetin, ethylene glycol diacetate, 2,5-diacetoxy-2,5-dihydrofuran, lactones, acylates, carboxamides, acyllactams, acylated ureas and oxamides, N-acylated hydantoins, for example 1-phenyl-3-acetylhydantoin, hydrazides, triazoles, hydrotriazines, urazoles, diketopiperazides, sulfurylamides, polyacylated alkylenediamines, for example N,N,N',N'-tetraacetylethylenediamine, acylated triazine derivatives, in particular 1,5-diacetyl-2,4-dioxohexahydro-1,3,5-triazine, acylated glycolurils, in particular tetraacetylglycoluril, N-acylimides, in particular N-nonanoylsuccinimide, and acylated sugar derivatives, in particular pentaacetylglucose, pentaacetylfructose, tetraacetylxylose and octaacetyllactose, and acylated, optionally N-alkylated glucamine and gluconolactone and/or N-acylated lactams, for example N-benzoylcaprolactam.

In addition to the abovementioned conventional bleach activators, or instead of them, it is also possible for sulfonimines and/or bleach-boosting transition metal salts or transition metal complexes to be present as so-called bleach catalysts, as described in DE 196 49 375.

Suitable enzymes are those from the class of proteases, such as BLAP, Optimase, Opticlean, Maxacal, Maxapem, Esperase, Savinase, Purifect OxP and/or Durazym, lipases, such as Lipolase, Lipomax, Lumafast and/or Lipozym, amylases, such as Termamyl, Ainylase-LT, Maxamyl, Duramyl and/or Purafect OxAm, and cutinases, pullulanases and mixtures thereof. Their proportion can be from 0.2 to 1% by weight. The enzymes can be adsorbed to carrier substances and/or embedded in coating substances.

Possible silver corrosion inhibitors are the compounds given in DE 196 49 375.

As foam regulators, it is possible to add, preferably, up to 6% by weight, in particular about 0.5 to 4% by weight, of foam-suppressing compounds, preferably from the group of silicone oils, mixtures of silicone oil and hydrophobicized silica, paraffins, paraffin/alcohol combinations, hydrophobicized silica, bis-fatty acid amides and other known commercially available antifoams.

To set a desired pH, the compositions according to the invention can comprise system- and environmentally-compatible acids, in particular citric acid, acetic acid, tartaric acid, malic acid, lactic acid, glycolic acid, succinic acid, glutaric acid and/or adipic acid, or else mineral acids, in particular sulfuric acid or alkali metal hydrogensulfates or bases, in particular ammonium or alkali metal hydroxides. Such pH regulators are present in the compositions according to the invention in amounts which, preferably, do not exceed 10% by weight, in particular in amounts of from 0.5 to 6% by weight.

Examples of suitable preservatives are phenoxyethanol, formaldehyde solution, pentanediol or sorbic acid. Abrasive substances which can be used are quartz flours, wood flours, plastics flours, chalk and microglass spheres.

Typical individual examples of further additives are sodium borate, starch, sucrose, polydextrose, stilbene compounds, methylcellulose, toluenesulfonate, cumenesulfonate, soaps and silicones.

The preparation of the compositions according to the invention in the form of non-dusting, storage-stable flowable powders and/or granules with high bulk densities in the range from 800 to 1000 g/l can be carried out by, in a first process stage, mixing the builder components with at least a fraction of liquid mixture components, with an increase in the bulk density of this premix, and subsequently—if desired after an intermediate drying—combining the further constituents of the composition, including the bleach activator, with the premix obtained in this way.

EXAMPLES

The examples below serve to illustrate the invention, without, however limiting it thereto.

Formulation of trimethylacetonitrileammonium chloride/silica

Example 1

300 g of the silica Sipernat® 50S (Degussa-Hüls) were introduced into a Lödige mixer, and, at about 20° C., 780 ml of an aqueous, approximately 67% strength by weight solution of trimethylacetonitrileammonium chloride were sprayed on using a two-material nozzle over a period of 27 minutes. After the spraying, after-mixing was carried out for 2 minutes.

Parameters:

Speed of mixing equipment: 120 per min

Fill amount: 0.3 kg

Degree of filling in the mixer: 65%

Temperature of mixing chamber: 23° C.

Temperature of the acetonitrile solution: 23° C.

Rate of addition of the solution: about 20–40 ml/min

Example 2

150 g of the silica Aerosil® 380 (Degussa Hüls) were introduced into a Lödige mixer, and, at about 20° C., 320 ml of an aqueous, approximately 67% strength by weight solution of trimethylacetonitrileammonium chloride were sprayed on with a two-material nozzle over a period of 9 minutes. After the spraying, after-mixing was carried out for 2 minutes Parameters:

Speed of mixing equipment: 120 per min

Fill amount: 0.15 kg

Degree of filling in the mixer: 70%

Temperature of mixing chamber: 21° C.

Temperature of the acetonitrile solution: 18° C.

Rate of addition of the solution: about 20–40 ml/min

Formulation Examples

Example 3

Machine Dishwashing Detergent (% by wt.)

| | |
|---|---|
| Sodium citrate | 41 |
| Sodium carbonate | 5 |
| Sodium hydrogencarbonate | 30 |
| Protease | 1 |
| Amylase | 1 |
| Glucamide | 2 |
| Sodium perborate monohydrate | 10 |
| Acetonitrile/Sipernat (52/48% by wt.) | 10 |

Example 4

Machine Dishwashing Detergent Tablets (% by wt.)

First phase:

| | |
|---|---|
| Sodium tripolyphosphate | 31 |
| Na perborate monohydrate | 10 |
| Acetonitrile/Sipernat (52/48% by wt.) | 3 |
| Polycarboxylate (Sokalan ® CP5) | 1 |
| Glucamide | 2 |
| Sodium carbonate | 15 |
| Phyllosilicate (SKS-6) | 6 |

Second phase:

| | |
|---|---|
| Sodium tripolyphosphate | 26% by wt. |
| Complexing agent (Turpinal ® 2NZ) | 1% by wt. |
| Protease granules (Blap ® 200) | 2% by wt. |
| Amylase granules (Duranyl ® 60 T) | 2% by wt. |
| Dye | 0.9% by wt. |
| Perfume | 0.1% by wt. |

Example 5

Textile Detergent (in % by wt.)

| | |
|---|---|
| Sodium percarbonate | 20.0 |
| Acetonitrile/Sipernat (52/48% by wt.) | 6.0 |
| Fatty alcohol sulfate Na salt | 10.0 |
| Soap | 1.0 |
| $C_{13}/C_{15}$-Oxo alcohol, 3EO | 4.0 |
| Glucamide | 1.5 |
| Zeolite A | 20.0 |
| Crystalline phyllosilicate | 10.0 |
| Acrylic/maleic acid, copolymer MW 70,000) | 5.0 |
| Sodium sulfate | 8.0 |
| Sodium carbonate | 6.0 |
| Citric acid | 5.0 |
| Carboxymethylcellulose | 1.5 |
| Lipase | 0.5 |
| Protease | 0.5 |
| Water | to 100 |

What is claimed is:

1. A particulate bleach activator comprising 15 to 60% by weight of an acetonitrile, 20 to 70% by weight of a silicon-containing carrier material, and 20 to 30% by weight of water.

2. The particulate bleach activator as claimed in claim 1, which comprises an acetonitrile of the formula

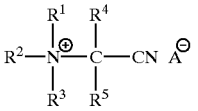

in which $R^1$, $R^2$, $R^3$ are identical or different and are linear or branched $C_1$–$C_{24}$-alkyl groups, $C_2$–$C_{24}$-alkenyl groups or are $C_1$–$C_4$-alkoxy-$C_1$–$C_4$-alkyl groups, substituted or unsubstituted benzyl, or in which $R^1$ and $R^2$, together with the nitrogen atom to which they are bonded, form a ring having 4 to 6 carbon atoms which may be substituted by $C_1$–$C_5$-alkyl, $C_1$–$C_5$-alkoxy, $C_1$–$C_5$-alkanoyl, phenyl, amino, ammonium, cyano, cyanamino, chlorine or bromine, and, in addition to the nitrogen atom, may contain one or two oxygen or nitrogen atoms, a group N—$R^6$ or a group $R^3$—N—$R^6$ instead of carbon atoms, in which $R^6$ is hydrogen, $C_1$–$C_5$-alkyl, $C_2$–$C_5$-alkenyl, $C_2$–$C_5$-alkynyl, phenyl, $C_7$–$C_9$-aralkyl, $C_5$–$C_7$-cycloalkyl, $C_1$–$C_6$-alkanoyl, cyanomethyl or cyano, $R^4$ and $R^5$ are hydrogen, $C_1$–$C_4$-alkyl, $C_2$–$C_4$-alkenyl, $C_1$–$C_4$-alkoxy-$C_1$–$C_4$-alkyl, phenyl or $C_1$–$C_3$-alkylphenyl, and A is an anion.

3. The particulate bleach activator as claimed in claim 1, which comprises an acetonitrile of the formula according to claim 2 in which $R^1$, $R^2$ and $R^3$ are $C_1$–$C_4$-alkyl, and $R^4$ and $R^5$ are hydrogen and A is an anion.

4. The particulate bleach activator as claimed in claim 1, which comprises 20 to 50% by weight of the acetonitrile.

5. The particulate bleach activator as claimed in claim 1, which comprises 35 to 45% by weight of the acetonitrile.

6. The particulate bleach activator as claimed in claim 1, which comprises 30 to 50% by weight of the carrier silicon-containing material.

7. The particulate bleach activator as claimed in claim 1, which comprises 35 to 45% by weight of the silicon-containing material.

8. The particulate bleach activator as claimed in claim 1, which comprises 22 to 25% by weight of water.

9. A process for the preparation of the particulate bleach activator as claimed in claim 1, which comprises applying a saturated aqueous solution of an acetonitile to a silicon-containing carrier material.

10. A process for the preparation of the particulate bleach activator as claimed in claim 1, which comprises applying an aqueous solution, saturated at 10 to 40° C., of an acetonitrile onto a silicon-containing carrier material.

11. A laundry detergent or cleaning composition comprising a particulate bleach activator as claimed in claim 1.

12. The particulate bleach activator as claimed in claim 2 wherein $R^4$ is hydrogen if $R^5$ is not hydrogen.

* * * * *